United States Patent [19]

Shew et al.

[11] Patent Number: 4,870,891

[45] Date of Patent: Oct. 3, 1989

[54] PNEUMATICALLY CONTROLLED AIR MOTOR

[75] Inventors: Jerry D. Shew, Niles; Stuart A. Evans, Wilmette, both of Ill.

[73] Assignee: Stewart Warner Corporation, Chicago, Ill.

[21] Appl. No.: 323,186

[22] Filed: Mar. 13, 1989

Related U.S. Application Data

[63] Continuation of Ser. No. 161,211, Feb. 17, 1988, abandoned, which is a continuation of Ser. No. 904,478, Sep. 8, 1986, abandoned.

[51] Int. Cl.[4] ..... F01L 25/04; F01L 25/02

[52] U.S. Cl. ..... 91/291; 91/305; 91/312; 91/319

[58] Field of Search ..... 91/290, 291, 300, 301, 91/305, 319, 323, 304, 312

[56] References Cited

U.S. PATENT DOCUMENTS

| | | | |
|---|---|---|---|
| 237,994 | 2/1881 | Murray, Jr. | 91/301 X |
| 637,243 | 11/1899 | Erb | 91/291 |
| 802,104 | 10/1905 | Howard | 91/312 X |
| 1,969,020 | 8/1934 | Le Cain | 91/301 X |
| 1,986,084 | 1/1935 | Tolkien | 91/301 X |

FOREIGN PATENT DOCUMENTS

| | | | |
|---|---|---|---|
| 20081 | 11/1956 | Fed. Rep. of Germany | 91/312 |
| 26546 | of 1905 | United Kingdom | 91/312 |

*Primary Examiner*—Robert E. Garrett
*Assistant Examiner*—Mark A. Williamson
*Attorney, Agent, or Firm*—Lorusso & Loud

[57] ABSTRACT

A double acting piston and cylinder air motor with pneumatically actuated pilot valves for shifting a directional control valve, where the pilot valves are controlled by pilot ports in the cylinder as they are uncovered by the piston.

11 Claims, 5 Drawing Sheets

PNEUMATICALLY CONTROLLED AIR MOTOR

This is a continuation of co-pending application Ser. No. 161,211 filed on Feb. 17, 1988, now abandoned, which is a cont. of U.S. Ser. No. 904,478 filed Sept. 8, 1986, now abandoned.

BACKGROUND OF THE PRESENT INVENTION

Reciprocating piston and cylinder devices have been known and utilized for many decades as pumps and motors. These piston and cylinder devices are generally either single acting or double acting. In single acting piston and cylinder devices fluid under pressure is ported selectively to only one side of the piston in a forward stroke and the piston is returned by by non-fluid pressure means such as a return spring.

In double acting piston and cylinder devices fluid under pressure is ported to one side of the piston to drive it in a forward stroke and alternately to the opposite side of the piston to drive it in a return stroke. Usually a main directional valve is provided for porting fluid under pressure from a source alternately to two main passages connected to opposite ends of the cylinder.

The present invention is concerned with the manner in which the directional control valve is shifted to effect this alternate porting of fluid under pressure to the two main fluid passages connected to the cylinder. Frequently poppet valves are provided that control fluid pressure on the opposite ends of the main directional control valve. Mechanical trip rods driven by the piston are sometimes used to actuate these poppet valves alternately to provide an unbalance in fluid pressure acting on the opposite ends of the main valve to cause shifting. Such a poppet valve arrangement while satisfactory for many applications is subject to wear because the poppet valve actuation requires mechanical engagement, and it also creates noise resulting from impacting the trip rod mechanism with the poppet valves.

Such an arrangement is shown in Australian Patent No. 515,191. The air motor shown in this patent requires the added cost of two piston actuated poppet valves and a reset assembly to reset the main valve in case of malfunction. This design also needs a pair of tiny bleed ports in the main valve that necessitate a strainer in the air inlet to prevent foreign particles from clogging the ports.

Scienco Corporation manufactures an air motor model no. AP-30 that does eliminate these undesirable poppet valves by pneumatically shifting the main spool or directional control valve. In order to effect shifting of the main valve however it is necessary to provide two different size pistons (differential area) to create the differential pressure necessary for valve shifting and this required addition significantly increases the cost of the overall air motor.

It is the primary objection of the present invention to ameliorate the problems noted above in reciprocating piston and cylinder devices.

SUMMARY OF THE PRESENT INVENTION

In accordance with the present invention a double acting piston and cylinder air motor is provided with pneumatically actuated pilot valves for shifting a directional control valve entirely pneumatically without utilizing any mechanical devices for effecting control valve shifting.

Toward this end a pneumatically shiftable main spool or control valve is provided that alternately ports air under pressure to one of two main passages connected to the opposite ends of the reciprocating piston and cylinder air motor. Air chambers at the opposite ends of this spool valve are selectively vented by a pair of pilot valves reciprocably mounted in and selectively engageable with a through-bore extending through the spool valve. These pilot valves are themselves shifted by a pair of piston-actuators responsive to pressure at pilot ports positioned just short of the end of the piston stroke so that when the piston uncovers a pilot port to the high pressure side of the piston, the corresponding actuator will shifts its pilot valve causing one side of the spool valve to be vented resulting in shifting the spool valve to port air under pressure the opposite side of the piston, reversing the direction of the piston and driving it in its reverse stroke.

In addition to spool valve shifting being effected entirely pneumatically in accordance with the present invention for both directions of movement of the piston, the present air motor has only a simple single area piston resulting in a significantly lower cost system than differential piston air motors. Furthermore the design and location of the pilot valves within the main spool valve result in a far more compact pilot and main valve assembly than heretofore known in the prior art.

Other objects and advantages of the present invention will appear from the detailed description of the invention.

DETAILED DESCRIPTION OF THE PREFERRED EMBODIMENT

Figure 1:
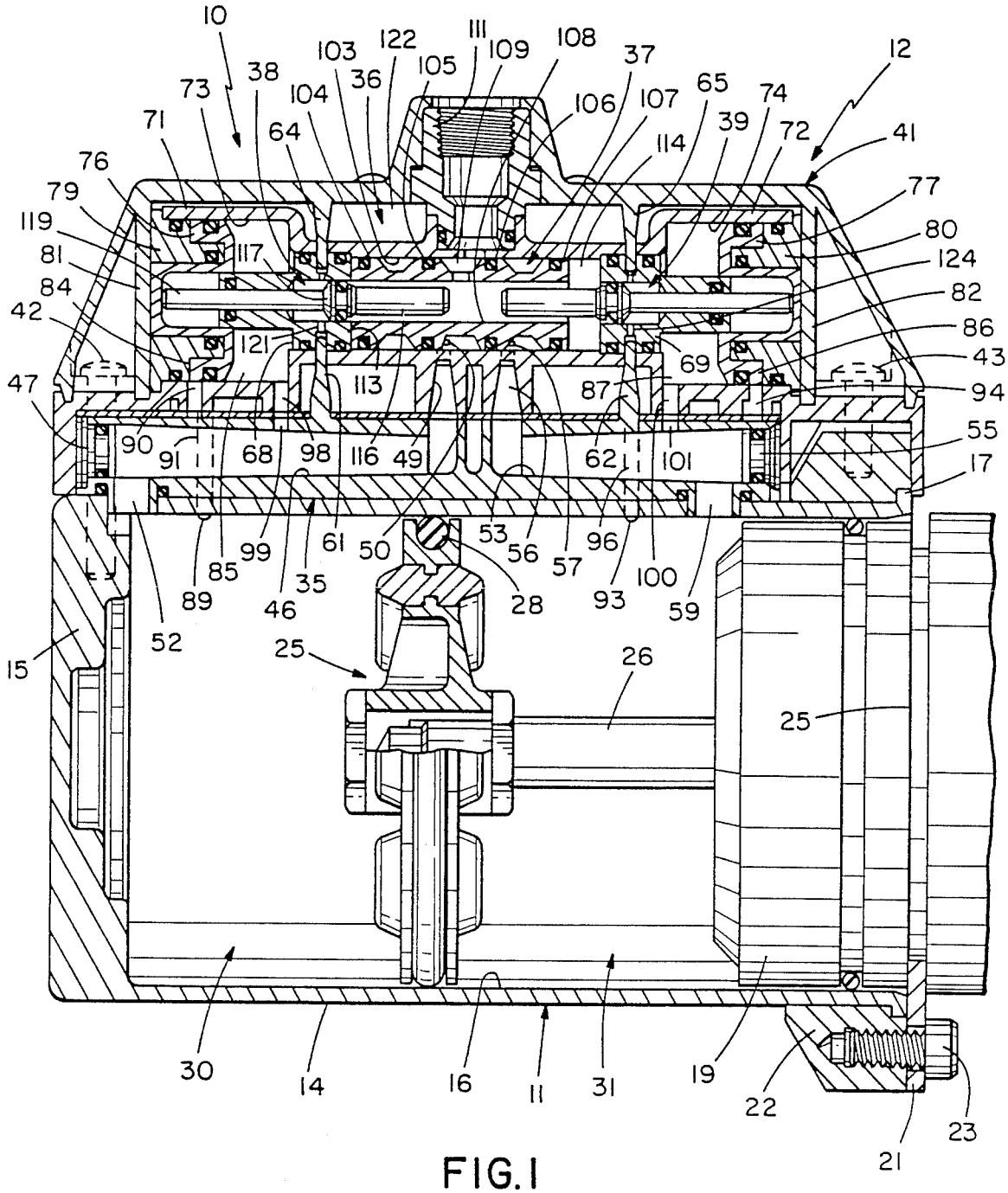
FIG. 1 is a longitudinal section of the present air motor illustrating the piston and cylinder assembly and a control valve assembly connected as a unit.

Referring to the drawings and particularly FIGS. 1 to 4, an air motor assembly 10 is illustrated consisting generally of a piston and cylinder assembly 11 and a control valve assembly 12. While the air motor 10 is a general utility reciprocating piston and cylinder air motor, one particular application is to drive a material handling reciprocating piston pump.

Viewing the longitudinal section of FIG. 1, the piston and cylinder assembly 11 includes a cylinder 14 with an integral closed end wall 15, and a cylinder bore 16 with a peripheral flange 17 at its open end. A piston guide 19 is fixed in the open end of cylinder 14 by a face plate 21 connected to a retaining ring 22 by plurality of fasteners 23. Face plate 21 extends into groove 25 in the guide 19 for axially locating the guide within the cylinder 11.

A piston assembly 25 is reciprocably mounted in the cylinder bore 16 and has a rod 26 fixed thereto that is slidably mounted in a through-bore in guide 19 for the purpose of aligning rod 26 and piston 25 for linear reciprocation within the cylinder 11.

Piston 25 has an annular elastomeric seal ring 28 that sealing engages the cylinder bore 16 to divide the cylinder 11 into distinct pressure chambers 30 and 31.

The control valve assembly 12 includes a manifold 35 mounted on the top side of cylinder 11, a valve housing 36 mounted on top of the manifold 35 and over retaining ring 22, reciprocably receiving spool valve 37, pilot valves 38 and 39, and a cover 41 that encloses the valve housing 36.

Fasteners 42 and 43 clamp the valve housing 36 against the manifold 35 and the manifold against the cylinder 11, and fasteners 42 threadedly engage the cylinder end plate 15 on the left side as viewed in FIG. 1, and fasteners 43 engage retaining ring 22 on the right side.

Figure 2:
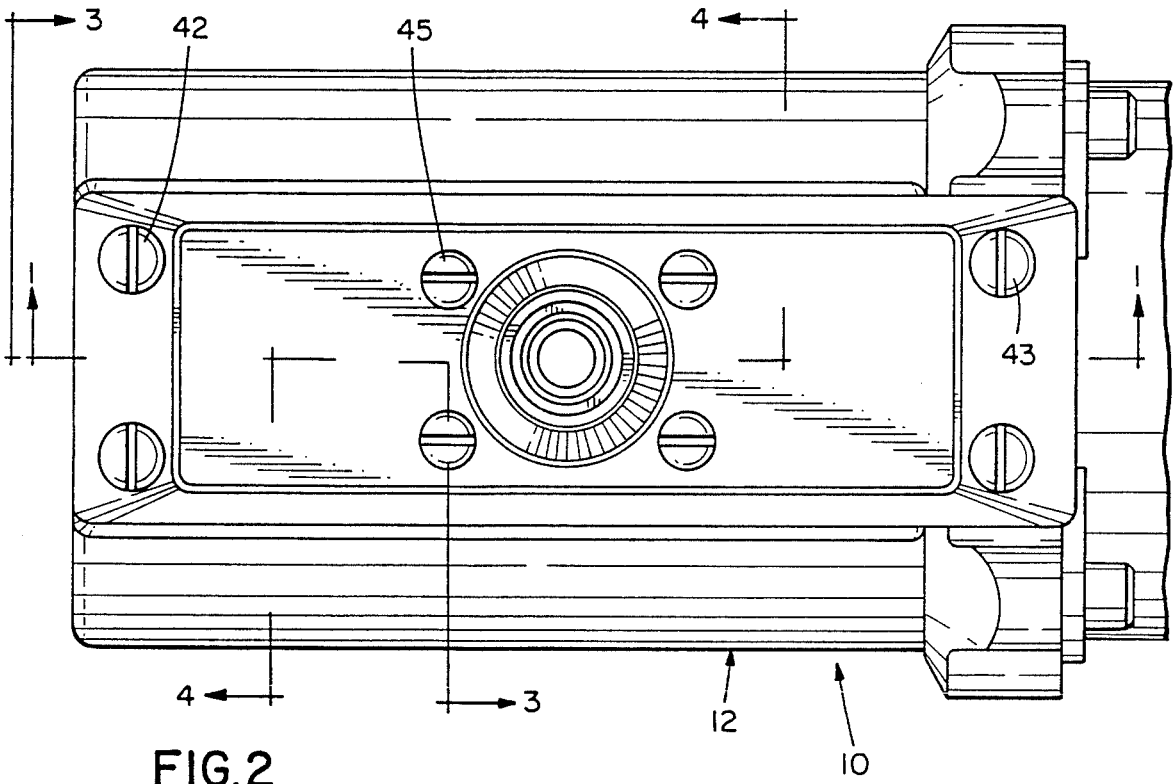
FIG. 2 is a top view of the air motor illustrated in FIG. 1.
Figure 3:
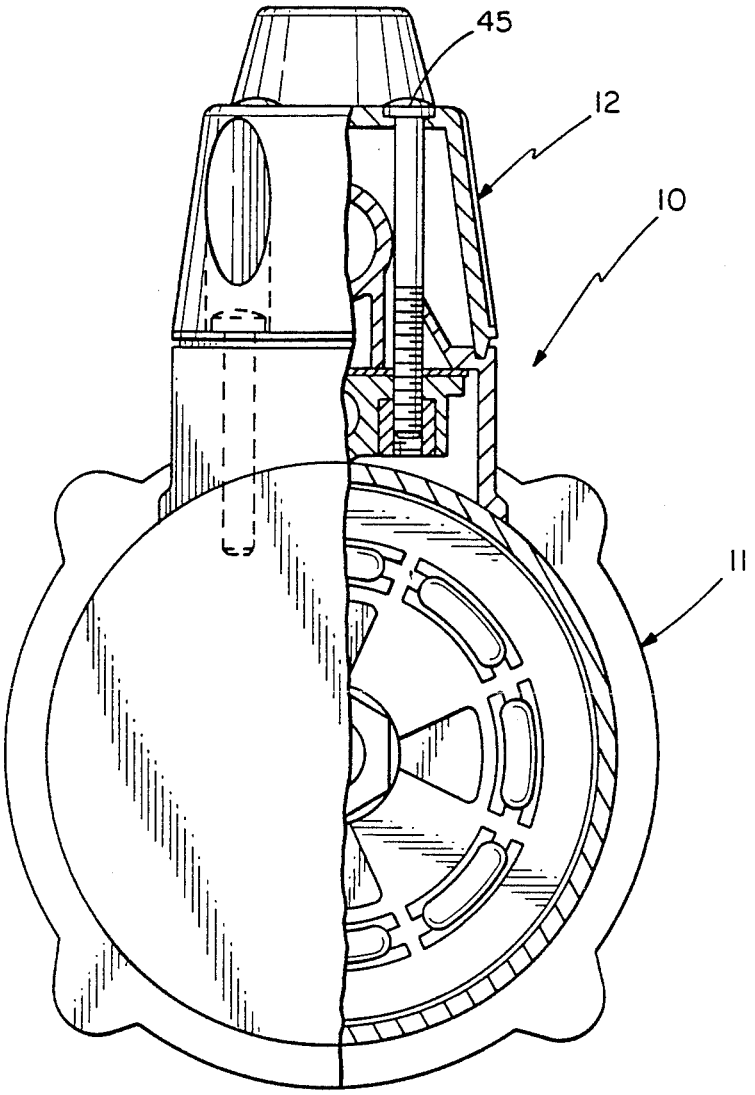
FIG. 3 is an irregular partly fragmentry left side view of the air motor illustrated in FIGS. 1 and 2 taken generally along line 3—3 of FIG. 2 illustrating the attachment of a cover, a valve housing, and a manifold forming the control valve assembly.

The cover 41 is clamped against the valve housing 36 and the valve housing against the manifold 35 with four fasteners 45 illustrated in FIGS. 2 and 3.

The manifold 35 has a large tapered central passage 46 extending from its left end as seen in FIG. 1 with its open end sealed by plug 47 and its right end communicating with passage 49 and ports 50 in valve housing 36. The left end of passage 46 communicates with cylinder chamber 30 through bore 52. An identical but reversed tapered passage 53 is formed in the right end of manifold 35 with its open end closed and sealed by plug 55, its left end communicating with valve housing passage 56 and ports 57, and its right end communicating with chamber 31 through bore 59.

The manifold 35 has upwardly extending projections 61 and 62 and the cover 41 has similar axially aligned downwardly extending projections 64 and 65 that fit within complementary recesses in the valve housing 36 and grooves in bushings 68 and 69 to axially locate the bushings within the valve housing 36.

The valve housing 36 has a pair of integral cylinders 71 and 72 formed at the opposite ends thereof with bores 73 and 74 therein that slidably receive actuator pistons 76 and 77 which operate the pilot valves 38 and 39 respectively. Cylinders 71 and 72 are closed by stepped annular bosses 79 and 80 held in position by end walls 81 and 82 in the cover 41.

Piston 76 defines chambers 84 and 85 in cylinder 73, while piston 77 defines chambers 86 and 87 in cylinder bore 74.

Figure 4:
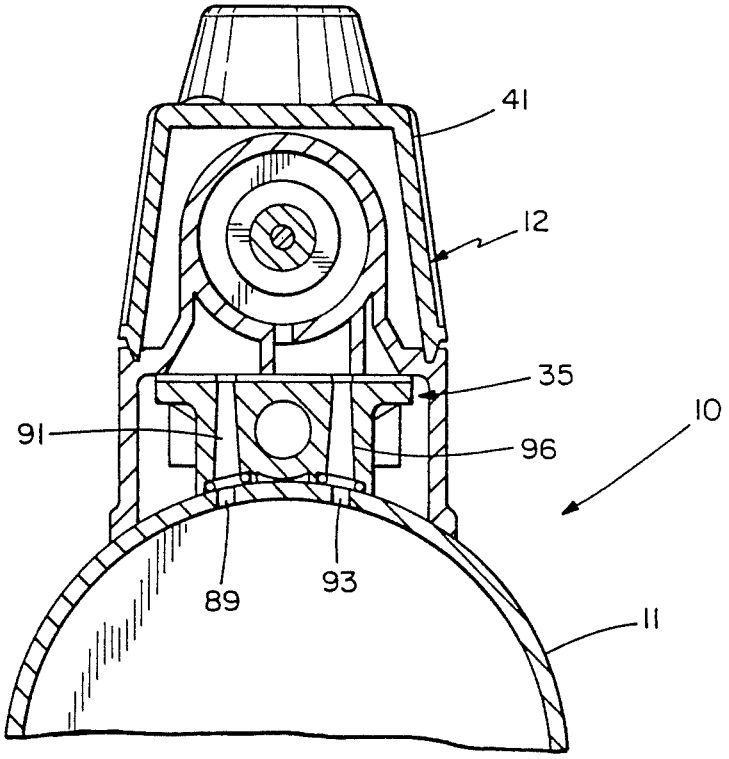
FIG. 4 is an offset cross-section illustrating the pilot passages communicating with the cylinder taken generally along line 4—4 of FIG. 2.

Chamber 84 communicates with a pilot port 89 in the left end of cylinder 11 through passage 90 in valve housing 36, an unshown cross-passage in the bottom of the valve housing 36, and passage 91 extending through manifold 35 offset from the main passage 46 as seen more clearly in FIG. 4.

Similarly chamber 86 associated with piston-actuator 77 communicates with a pilot port 93 in the right end of the cylinder 11 through passage 94 in valve housing 36, an unshown cross-passage 95 in the bottom of the valve housing 36, and offset passage 96 extending through the manifold 35. Port 89 and passage 91 are on the opposite side of the motor center-line from port 93 and passage 96 therefore are only shown in FIG. 1 for ease of understanding.

The right chamber 85 associated with piston-actuator 76 communicates with main passage 46 through reset passage 98 in valve housing 36 and passage 99 in manifold 35, and similarly the left chamber 87 associated with piston 77 communicates with main passage 53 in manifold 35 through reset passage 100 in valve housing 36 and passage 101.

The spool or directional control valve 37 is generally annular in configuration and slidably mounted in valve bore 103 in the valve housing 36 and is seen to include a plurality sealing lands 104, 105, 106, and 107, a central through-bore 108, and central cross passage 109 that communicates the interior of the valve 37 continuously with inlet pressure from inlet fitting 111. Valve 37 defines pressure chambers 113 and 114 in bore 103 that when pressurized effect shifting of the valve 37.

The pilot valves 38 and 39 are identical and include an enlarged stem portion 116, a sealing land 117 slidable in both in the valve bore 108 and an equal diameter bore in bushing 68, and reduced stem portion 119 slidable in a complementary reduced diameter bore in bushing 68. Pilot valve 39 is mounted in bushing 69. Pilot valve sealing lands 117 when positioned in their associated bushings 68, 69 isolate chambers 113, 114 from an exhaust passages 121, 124 connected to an exhaust chamber 122 surrounding the valve housing, and when positioned outside their associated bushings 68, 69 connect chambers 113, 114 to exhaust through passages 121, 124.

The operation of the air motor 10 will be described with reference to the schematic diagrams of FIGS. 5 to 8. With valve 37 initially in its left position illustrated in FIG. 5, and with the pilot valves 38 and 39 in their outward or normal positions shown, control valve 37 ports fluid from inlet 111 to the left side of piston 25 through main passage 46 driving the piston to the right.

Simultaneously the right side of piston 25 is exhausted through main passage 53, port 57, between lands 106 and 107, and into exhaust passage 122.

Since spool valve passage 109 continuously communicates with inlet fluid pressure at inlet 111 the interior of valve 37 is continuously pressurized biasing pilot valves 38 and 39 outwardly against the actuators 76 and 77. As the piston-actuators 76 and 77 are in effect differential area pistons, i.e. chambers 84 and 86 are smaller than chambers 85 and 87 in terms of their effective area on the pistons, when the opposite sides of the pistons 76 and 77 are simultaneously pressurized the pistons will move to their outer-positions illustrated in FIG. 5. Thus in the FIG. 5 condition when chamber 85 is pressurized through reset passage 98 at the same time chamber 84 is pressurized through pilot passage 90, the piston 76 will be biased to the outermost position shown. Furthermore because the pilot valve seal-land 117 is larger than the pilot stem 119, both of the pilot valves 38 and 39 are continuously biased toward third outward or normal positions by inlet pressure within valve 37.

Figure 5:
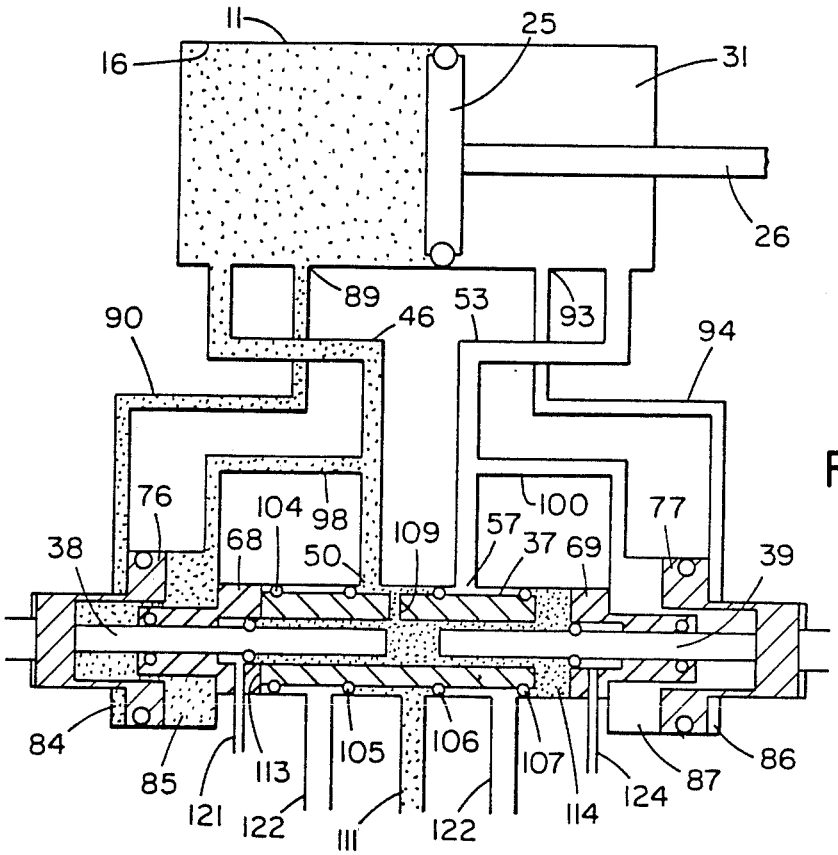
FIGS. 5 to 8 are schematic views of the piston and cylinder assembly and control valve assembly in sequential stages of operation.
Figure 6:
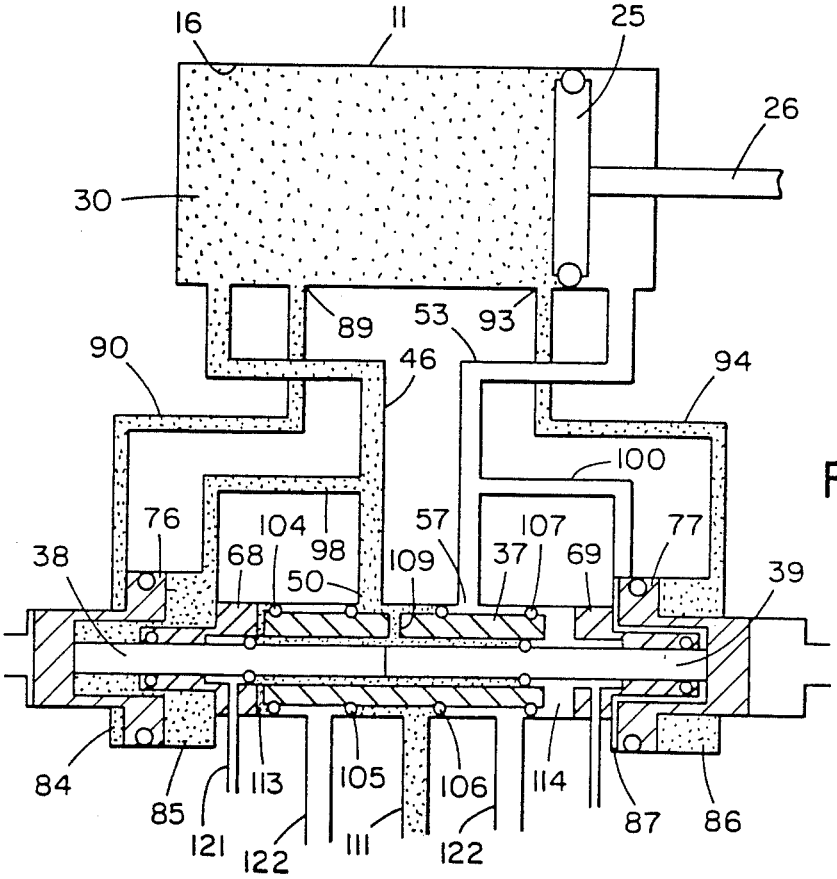
Figure 7:
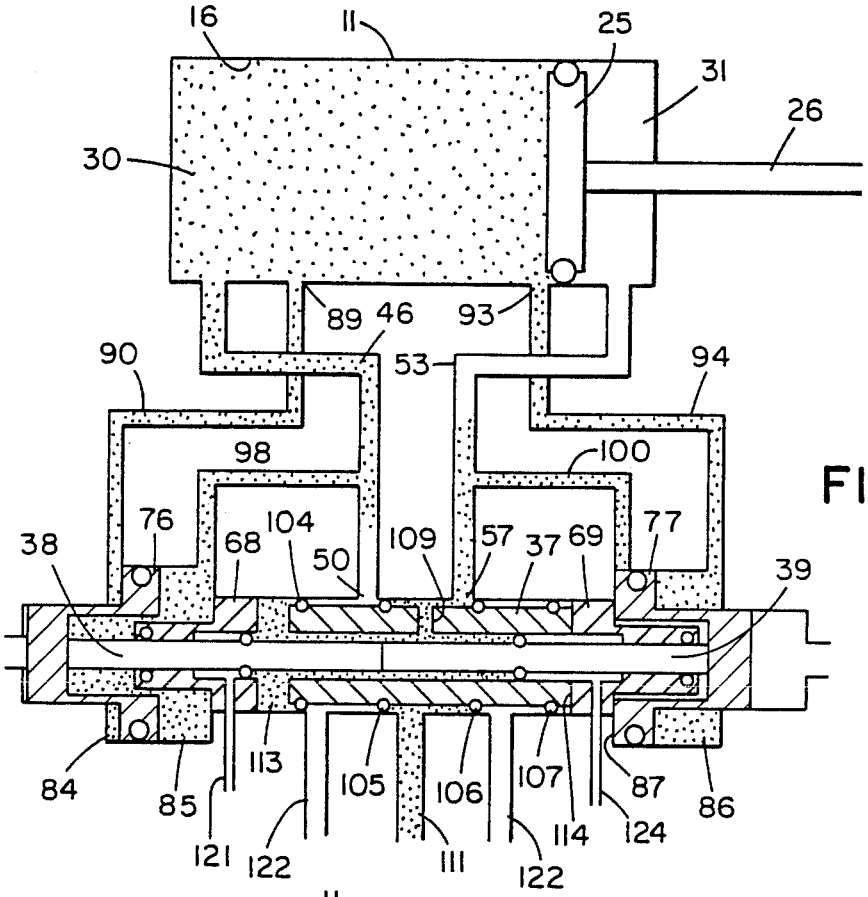

As piston 25 continues to move to the right from its position illustrated in FIG. 5 under high pressure supplied by valve 37 when in its left position, piston 25 will uncover pilot port 93 as illustrated in FIG. 6. causing high pressure in cylinder chamber 30 to be applied to the chamber 86 against piston 77 causing it to move to its left most position illustrated in FIG. 6, shifting pilot valve 39 to the left against pilot valve 38, and connecting chamber 114 to exhaust passage 124. Because valve chamber 113 remains pressurized this causes spool or control valve 37 to move from its left-most position illustrated FIG. 5 to its right-most position illustrated in FIG. 7.

This shifting of main valve 37 to the right connects the formerly pressurized main passage 46 to exhaust 122 across valve 37 between main spool valve lands 104 and 105, and connects inlet 111 to main passage 53 across valve lands 105 and 106 pressurizing cylinder chamber 31 to reverse piston 25 and begin its movement toward the left in its return stroke.

Figure 8:
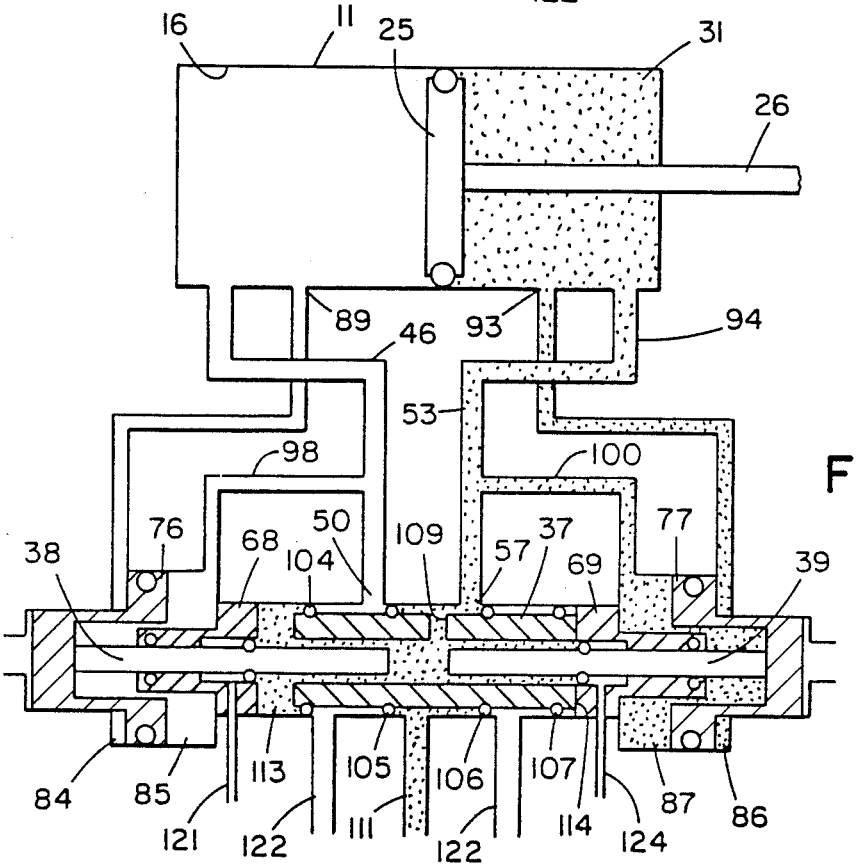

At the same time reset passage 100 is pressurized with connected chamber 87, driving piston-actuator 77 toward its outer-most normal position illustrated in FIG. 8, and at the same time pilot valve 39 follows to its outer position because of the differential pressure acting on it.

Piston 25 then continues to the left with valve member 37 in its right-most position past the position illustrated in FIG. 8 until it uncovers port 89 to high pressure fluid in chamber 31 at which time pilot passage 96 pressurizes chamber 84 shifting piston-actuator 76 to the right, venting chamber 113 to exhaust passage 121 causing shifting of the valve 37 back to its left-most position, simultaneously pressurizing passage 46 across lands 105 and 106 and exhausting passage 53 between lands 106 and 107 reversing the movement of piston 25 toward the right to its initial position illustrated in FIG. 5 and at the same time piston-actuator 76 is reset to its outer-position through reset passage 98 and chamber 85.

We claim:

1. A reciprocating piston and cylinder device, comprising: a cylinder, a piston reciprocably mounted in the cylinder, a source of fluid under pressure, a control valve for porting fluid alternately to either end of the cylinder including a first passage connected to one end of the cylinder and a second passage connected to the other end of the cylinder, a main valve member movable to a first position porting fluid under pressure to the first passage and exhausting the second passage and a second position porting fluid under pressure to the second passage and exhausting the first passage, said main valve member having a central bore therethrough continuously communicating with the source of fluid under pressure, first and second fluid pressure chambers at the opposite ends of the main valve member, a first pilot valve coaxial with the main valve member responsive to pressure near one end of the cylinder for porting fluid relative to the first chamber to shift the valve member to its first position, and a second pilot valve coaxial with the main valve member responsive to pressure near the other end of the cylinder for porting fluid relative to the second chamber to shift the valve member to its second position said first and second pilot valves being constructed to selectively port fluid under pressure from the through bore to the first and second fluid pressure chambers at the opposite ends of the valve member to shift the valve member from its first to its second position.

2. A reciprocating piston a cylinder device as defined in claim 1, including a first and second coaxial fluid operated actuator for each of the first and second pilot valves, a pilot passage communicating with one end of the cylinder for porting fluid in the cylinder to operate the first actuator for the first pilot valve, and a second pilot passage communication with the other end of the cylinder for porting fluid in the cylinder to operate the second actuator for the second pilot valve.

3. A reciprocating piston and cylinder device as defined claim 2, including reset passages communicating with the first and second passages for resetting the actuators as the valve member initially and sequentially ports fluid under pressure to the first and second passages.

4. A reciprocating piston cylinder device, comprising: a cylinder, a piston reciprocably mounted in the cylinder, a source of fluid under pressure, a control valve for porting fluid alternately to either end of the cylinder including a first passage connected to one end of the cylinder and a second passage connected to the other end of the cylinder, a main valve member movable to a first position porting fluid under pressure to the first passage and exhausting the second passage and a second position porting fluid under pressure to the second passage and exhausting the first passage, first and second fluid pressure chambers at the opposite ends of the main valve member, a first pilot valve coaxial with the main valve member responsive to pressure near one end of the cylinder for porting fluid under pressure relative to the first chamber to shift the valve member to its first position, a second pilot valve coaxial with the main valve member responsive to pressure near the other end of the cylinder for porting fluid under pressure relative to the second chamber to shift the valve member to its second position, a first pilot passage communicating one end of the cylinder to port fluid under pressure in the cylinder as the piston passes thereover to operate the first pilot valve, and a second pilot passage communicating with the other end of the cylinder to port fluid under pressure in the cylinder as the piston passes thereover to operate the second pilot valve, said main valve member forming a part of the first and second pilot valves.

5. A reciprocating piston and cylinder device as defined in claim 4, including a first and second fluid operated actuator for each of the first and second pilot valves, said first pilot passage communicating with one end of the cylinder porting fluid in the cylinder to operate the first actuator for the first pilot valve, and said second pilot passage communicating with the other end of the cylinder porting fluid in the cylinder to operated the second actuator for the second pilot valve.

6. A reciprocating piston and cylinder device as defined in claim 5, including reset passages communicating with the first and second passages for resetting the actuators as the valve member initially and sequentially ports fluid under pressure to the first and second passages.

7. A reciprocating piston and cylinder device as defined in claim 4, wherein the main valve member has a central bore therethrough communicating with the source of supply, said first and second pilot valves each including a pilot valve member selectively engageable with the central bore in the valve member to control fluid pressure in the first and second chambers.

8. A reciprocating piston and cylinder device as defined in claim 7, wherein the pilot valve members have "O" rings slidable in the main valve member throughbore.

9. A valve assembly for a reciprocating piston and cylinder device, comprising: a main valve member for alternately porting fluid under pressure from a supply port to first and second passages and oppositely exhausting those passages, a fluid pressure chamber at each end of the valve member that when pressurized causes the valve member to move alternately to a first position connecting the supply port to the first passage and the second passage to exhaust and a second position connecting the supply port to the second passage and the first passage to exhaust, a first pilot valve reciprocably mounted concentrically in the main valve member for selectively porting fluid under pressure to a chamber at one end of the valve member and a second pilot valve reciprocably mounted concentrically in the main valve member for selectively porting fluid to a chamber at the other end of the valve member, and a fluid actuator coaxial with each of the pilot valves for operation thereof, the main valve member having a through-bore that is selectively engaged by the first pilot valve at one end and the second pilot valve at the other end thereof, said main valve member through-bore continuously communicating with the supply port so it is under continuous fluid pressure, said pilot valves being constructed to selectively port fluid under pressure from the through-bore to the chambers at the opposite ends of the valve member as they disengage the main valve member to shift the main valve member from its first position to its second position, said pilot valves each including a valve member having an "O" ring selectively engageable in the through-bore in the main valve member.

10. A reciprocating piston and cylinder device, comprising: a cylinder, a piston reciprocably mounted in the cylinder, a source of fluid under pressure, a control valve for porting fluid alternately to either end of the cylinder including a first passage connected to one end of the cylinder and a second passage connected to the other end of the cylinder, a valve member movable to a first position porting fluid under pressure to the first passage and exhausting the second passage and to a second position porting fluid under pressure to the second passage and exhausting the first passage, a first pilot valve responsive to pressure near one end of the cylinder for shifting the valve member to its first position, a second pilot valve responsive to pressure near the other end of the ylinder for shifting the valve member to its second position, a first pilot passage communicating one end of the cylinder to port fluid under pressure in the cylinder as the piston passes thereover to operate the first pilot valve, a second pilot passage communicating with the other end of the cylinder to port fluid under pressure in the cylinder as the piston passes thereover to operate the second pilot valve, a fluid pressure chamber at each end of the valve member that when pressurized causes the valve member to move alternately to a first position connecting the supply port to the first passage and the second passage to exhaust and to a second position connection the supply port to the second passage and the first passage to exhaust, said first pilot valve reciprocably mounted concentrically in the valve member for selectively porting fluid under pressure to the chamber at one end of the valve member and said second pilot valve reciprocably mounted concentrically in the valve member for selectively porting fluid to the chamber at the other end of the valve member, and a fluid actuator coaxial with each of the pilot valves for operation thereof, the valve member having a through-bore that is selectively engaged by the first pilot valve at one end and the second pilot valve at the other end thereof, said valve member through-bore continuously communicating with the supply port so it is under continuous fluid pressure, said pilot valves being constructed to selectively port fluid under pressure from the through-bore to the chambers at the opposite ends of the valve member to shift the valve member from its first position to its second. position, said pilot valves each including a valve member having an "O" ring selectively engageable in the through-bore in the main valve member.

11. A reciprocating piston and cylinder device, comprising: a cylinder slidably receiving a piston, a shiftable valve connected to selectively port fluid under pressure to the cylinder to cause reciprocation of the piston therein, and an actuator responsive to pressure in a pilot passage in the cylinder as the piston passes thereover for shifting the valve, a pilot valve member controlled by the actuator for selectively porting fluid to one side of the valve for shifting the valve, the pilot valve member being reciprocably mounted in the valve with one end projecting therefrom, said actuator being located adjacent to the projecting end of the pilot valve member.

* * * * *